United States Patent [19]

Eigner

[11] 4,211,369

[45] Jul. 8, 1980

[54] TUMBLING MILLS

[75] Inventor: Erich Eigner, Lödersdorf, Austria

[73] Assignee: Waagner-Biro Aktiengesellschaft, Vienna, Austria

[21] Appl. No.: 904,915

[22] Filed: May 3, 1978

[30] Foreign Application Priority Data

May 5, 1977 [AT] Austria ..... 3187/77

[51] Int. Cl.[2] ..... B02C 17/22

[52] U.S. Cl. ..... 241/182; 241/299

[58] Field of Search ..... 241/181–183, 241/299, 284

[56] References Cited

U.S. PATENT DOCUMENTS

| | | | |
|---|---|---|---|
| 1,741,604 | 12/1929 | Barratt | 241/183 X |
| 1,748,039 | 2/1930 | Kennedy | 241/183 |
| 2,998,201 | 8/1961 | Ratkowski | 241/183 |
| 3,880,365 | 4/1975 | Eigner | 241/182 |

FOREIGN PATENT DOCUMENTS

| | | | |
|---|---|---|---|
| 1000220 | 8/1965 | United Kingdom | 241/183 |
| 138800 | 6/1960 | U.S.S.R. | 241/183 |

*Primary Examiner*—Howard N. Goldberg
*Attorney, Agent, or Firm*—Steinberg & Blake

[57] ABSTRACT

A tumbling mill such as a tube or ball mill, wherein an outer shell is provided with an interior liner made up of a series of rings surrounding and distributed along the axis of the shell and each defining and surrounding an interior hollow milling space which has the cross section of a star with rounded points, in a plane normal to the shell axis, with this space having sharp corners extending inwardly toward the shell axis and alternating with the rounded points. The series of rings which form the liner in the shell are angularly offset one with respect to the next in a haphazard, non-uniform manner, and the configuration of the star-shaped space which is surrounded by each ring is that of a pair of superposed squares which have rounded corners and which are angularly offset one with respect to the other so that the rounded corners of one square alternate with the rounded corners of the other square to provide the space which is surrounded by each ring with the configuration of an eight-pointed star having rounded points.

5 Claims, 5 Drawing Figures

TUMBLING MILLS

BACKGROUND OF THE INVENTION

The present invention relates to tumbling mills, and in particular to tube or ball mills for wet and dry grinding systems and having many fields of application such as ore processing for the mining and metallurgical industry, providing closely graded or uniform particles for flotation processes, coarse sand production for glassworks, rock grinding for lime and cement works, phosphates, apatite, heavy spark, talc, pirophyllite, or the like, coal grinding, gypsum pulverization, cement production, slag and ash grinding, and magnesium oxide grinding.

The present invention relates in particular to that type of tumbling mill which has at least one milling chamber of polygonal cross section provided with rounded corners and defined by a series of rings each of which includes a row of plates circumferentially distributed about the axis of the mill, with the milling action taking place as a result of the falling and rolling movement of the milling bodies.

Mills of the above general type which have an interior hollow space of polygonal cross section, particularly square cross section with rounded corners are already known. With such mills of relatively large diameter there are large dead spaces so that such mills have only a relatively low volumetric efficiency. Moreover, with such conventional mills the bearings for the rotary mill are stressed to an excessively high degree while the number of impacts between the milling bodies and material to be milled is relatively small for each revolution and at the same time the impacts are not uniformly distributed during each revolution.

SUMMARY OF THE INVENTION

It is accordingly a primary object of the present invention to provide a tumbling mill of the above general type which will avoid the above drawbacks.

In particular, it is an object of the present invention to provide a tumbling mill which has an interior cross-sectional configuration which will greatly reduce the non-utilized dead space in the interior of the mill.

Furthermore it is an object of the present invention to provide a tumbling mill wherein the number of impacts between the milling bodies and the material to be milled is increased during each revolution of the mill, as compared to conventional mills, while at the same time the impacts during each revolution are uniformly distributed during each revolution of the mill.

Furthermore, it is an object of the present invention to provide a mill of the above general type which is capable of closely controlling such factors as the classified distribution of the milling bodies along the interior of the mill, the size and configuration of the particles of the final product, and the extent to which the material which is ground is subjected both to a rolling action of the milling bodies to be ground by attrition or a crushing action of the milling bodies to be ground by impact with the milling bodies.

According to the invention the mill has an interior hollow space the cross section of which is determined by a series of rings mounted within an outer shell and each made up of a series of plates circumferentially distributed about the axis of the shell. Each of these rings defines for the mill an interior hollow space which has the configuration of a star having rounded points, in particular the configuration of a pair of squares which have rounded corners and which are superposed on each other with one of the squares being offset with respect to the next so that the space of star-shaped configuration has a series of eight rounded points distributed about the axis of the shell. Furthermore, between the rounded star points the hollow interior space has inwardly extending relatively sharp corners which extend inwardly toward the axis of the shell and which alternate with the rounded star points. The above rings are preferably angularly offset one with respect to the next in a non-uniform manner. Moreover, the radii of curvature of the rounded corners of one of these squares, all of which may be equal to each other, are different from the radii of curvature of the rounded corners of the other of the squares, although the latter radii of curvature also may all be equal to each other. As a result the successive rounded star points respectively have different radii of curvature. Some of the plates of some of the rings preferably have inner surfaces which are inclined with respect to the axis of the mill so as to have a non-parallel relationship with respect thereto, and also at least some of the plates of some of the rings may be supported by a bedding means carried by the shell and situated between the latter and the plates which are supported by the bedding and form at least part of a ring.

The particular configuration of the hollow cross-sectional interior of the mill of the invention intensifies the falling or dropping movement of the milling bodies, so that the use of the structure of the invention as the first chamber of a multiple-chamber mill is particularly advantageous. At the same time, by providing different radii of curvature for the rounded star points which are situated in a common plane normal to the mill axis, during each revolution the angle at which the milling bodies are thrown inwardly away from the inner surface of the mill changes by approximately twice the extent possible with conventional mills, so that on the one hand the extent to which the material to be milled and the milling bodies are mixed with each other is increased and on the other hand there are double the number of impacts between the milling bodies and the material to be milled during each revolution as compared to a conventional mill having a liner which is of a simple square-shaped cross section. By angularly offsetting the series of rings along the mill axis the number of impacts between the milling bodies and the material to be milled per unit of time is rendered uniform, so that in this way the bearings are uniformly stressed.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
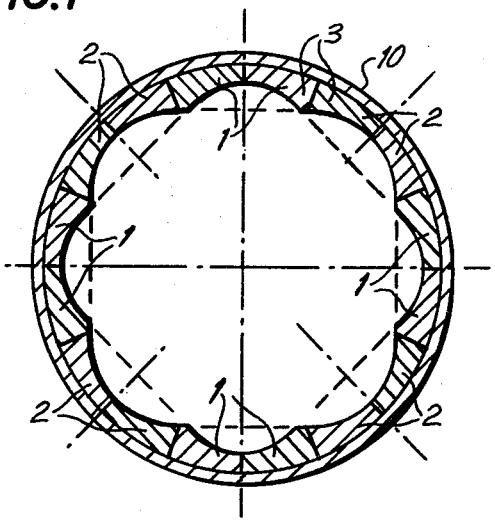
FIG. 1 is a schematic transverse cross-sectional illustration of an embodiment of a mill according to the invention.
Figure 5:
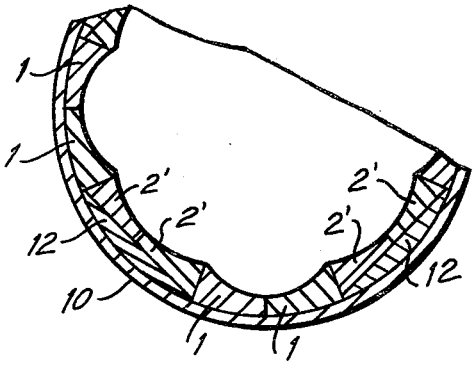
FIG. 5 is a fragmentary transverse sectional elevation of a further embodiment of the invention.

Referring to FIG. 1, there is shown therein in a schematic transverse cross section one possible embodiment of a mill according to the invention. The illustrated structure includes an outer shell means 10 which is of cylindrical configuration and which has a central axis which is normal to the plane of FIG. 1. This central axis is surrounded by a series of rings which form a liner means situated in the interior of the shell means 10 and lining the same, each of these rings being made up of a series of plates 1 and 2 which are distributed circumferentially along each ring. Thus it will be seen that the ring of the liner means which is apparent in FIG. 1 circumferentially surrounds the central axis of the shell means 10 to define in the interior of the mill a space having the illustrated cross-sectional configuration in a plane which is normal to the central axis of the shell means 10. In accordance with one of the features of the invention, the hollow interior space which is defined by each ring of the liner means has the configuration of a star the points of which are rounded with the space of star-shaped configuration having between the rounded points thereof inwardly extending corners which extend inwardly toward the axis of the shell means 10 and which have sharp edges alternating with the rounded points of the star. In FIG. 1 the space of star-shaped configuration which is defined by the ring of the liner means is formed by superimposed squares which have rounded corners and which are angularly offset one with respect to the other so that the rounded corners of one square alternate with the rounded corners of the other square to provide in this way a space of star-shaped configuration which has eight rounded points. It will be seen from FIG. 1 that the ring of the liner means illustrated therein includes sixteen plates 1 and 2 which are circumferentially distributed about the axis of the shell means 10 to form the illustrated ring of the liner means. These plates 1 and 2 are arranged in pairs with one pair of plates 1 being followed by one pair of plates 2 which in turn are followed by a pair of plates 1, and so on, circumferentially around the axis of the shell means 10. Each pair of plates 1 or pair of plates 2 are symmetrical with respect to a diagonal extending between each pair of plates 1 or pair of plates 2 where they abut each other. Each pair of plates 1 differs from each pair of plates 2 with respect to the radius of curvature of the rounded corner or star point defined thereby. Thus, in the illustrated example each pair of plates 1 have inner surfaces which are a continuation of each other and which are concave, defining a rounded corner or point of a radius of curvature which is smaller than the radius of curvature of the corresponding rounded point or corner formed by the inner concave surfaces of each pair of plates 2. Thus, the rounded star points or corners formed by the successive pairs of plates 1 and 2 provide the space of star-shaped configuration with successive rounded points which successively have different radii of curvature, although all of the plates 1 which define the four rounded corners of one square have equal radii of curvature and all of the plates 2 which define the four rounded corners of the other square have equal radii of curvature. The several plates 1 and 2 of each ring of the liner means are directly bolted to the shell means 10 in the illustrated example so that in the example of FIG. 1 there is no supporting structure such as a bedding means on which the plates are seated with the bedding means being situated between the shell 10 and the plates. However, such a bedding means can be provided with the structure of the invention, with the bedding means taking any desired form and being made of any suitable material without influencing the operation of the liner means of the invention. Thus FIG. 5 shows a construction where the shell means 10 has the several pairs of plates 1 directly bolted thereto, but in this case the several pairs of plates 2' are supported on a bedding means 12 which forms a seat for each pair of plates 2', this bedding means 12 itself being fixed in any suitable way to the inner surface of the shell 10 between the pairs of successive plates 1. The plates 2' of FIG. 5 can be fixed to the bedding means 10 in any suitable way such as by having dovetail projections received in dovetail slots of the bedding means 12, the latter being made, for example, of a springy material into which the dovetail projections at the outer surfaces of the plates 2' can snap. Thus, in this way it is possible to mount the plates 2' in the interior of the mill without requiring the use of any bolts, screws, or the like. If desired the same type of mounting without the use of screws, bolts, or the like can be used for mounting the plates 1 or 2 directly at the inner surface of the shell means 10. For example, the shell means 10 can carry at its inner surface dovetail projections received in the dovetail grooves of the plates 1 or 2.

Figure 2:
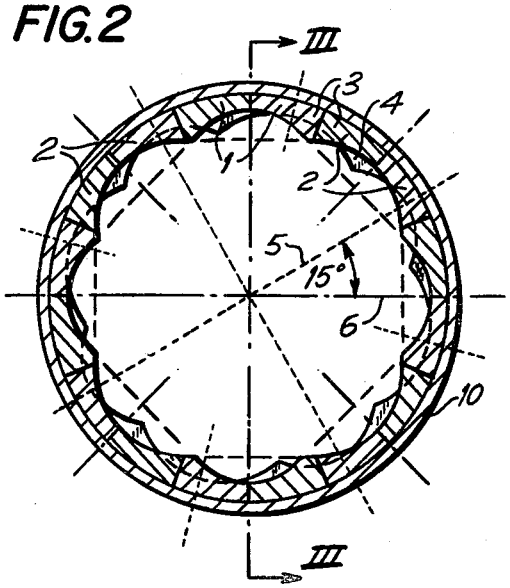
FIG. 2 shows the structure of FIG. 1 while also illustrating a liner ring behind the ring shown in FIG. 1, FIG. 2 being taken along line II—II of FIG. 3 in the direction of the arrows.

FIG. 2 illustrates a pair of rings 3 and 4 of the illustrated liner means of the invention, these rings 3 and 4 being identical since each is made up of a series of the plates 1 and 2 distributed circumferentially around the axis of the shell means 10. The ring 3 includes the illustrated dot-dash line diagonals 6 while the ring 4 situated behind the ring 3 as viewed in FIG. 2 includes the dotted line diagonals 5, and it will be seen that these diagonals are angularly offset with respect to each other by an angle of 15°, so that in the illustrated example the ring 4 is angularly offset with respect to the ring 3 around the axis of the shell means 10 by an angle of 15°.

Figure 3:
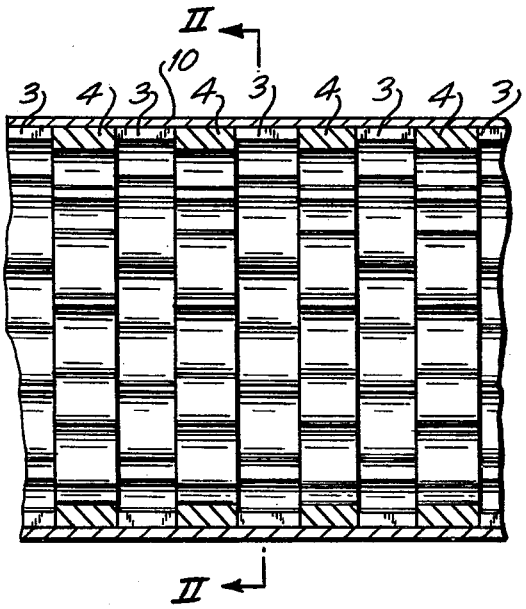
FIG. 3 is a fragmentary longitudinal sectional elevation of the structure of FIG. 2 taken along line III—III of FIG. 2 in the direction of the arrows.

Referring to FIG. 3, it will be seen that the series of rings 3 and 4 which form the liner means surrounding the axis of the shell means 10 alternate with each other along the axis of the shell means 10, so that each ring is situated between a pair of rings which are angularly offset with respect thereto. However it is to be understood that the angular offset of one ring with respect to the next along the axis of the shell means 10 preferably is not uniform so that there is from one ring to the next a haphazard angular offset with respect to the axis of the shell means 10.

Figure 4:
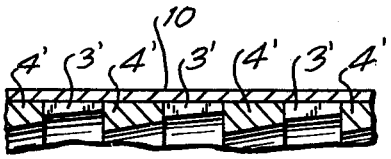
FIG. 4 is a fragmentary sectional elevation taken in the same plane as FIG. 3 of another embodiment of the invention.

As may be seen from FIG. 4, it is also possible to provide rings 3' and 4' which are the same as the rings 3 and 4 except that the inner surfaces of the rings 3' and 4' are inclined with respect to the axis of the shell means 10 so as to have a non-parallel relationship with respect thereto. As a result of this feature it is possible to accelerate or retard the movement of the material which is to be milled through the mill, depending upon the direction in which the material which is to be milled travels through the mill. Thus if this material travels to the left, as viewed in FIG. 4, the inclination of the inner surfaces of the rings will retard the movement whereas if the material to be milled travels toward the right, as viewed in FIG. 4, then the inclination of the inner surfaces of the rings will accelerate the movement of the material.

The present invention is a further development of that type of structure which is shown in U.S. Pat. No. 3,880,365 in which there are rings similar to those of the present invention but defining interior hollow spaces which are in the form of simple squares having rounded corners. As is apparent from FIG. 1 of the present application the space surrounded in the interior of the shell means 10 by each ring 3 or 4 of the liner means has in a plane normal to the axis of the shell the cross-sectional configuration of an eight-pointed star having rounded points, while also having between these rounded points inwardly extending relatively sharp-edged corners which thus alternate with the rounded points as illustrated in FIG. 1. The configuration of the hollow interior space shown in FIG. 1 is achieved by superimposing on each other a pair of squares which have rounded corners and which are angularly offset one with respect to the other so that the pairs of plates 1 define the rounded corners of one of the squares while the pairs of plates 2 define the rounded corners of the other of the squares. As a result the interior milling space which is available for milling the material which is to be milled becomes increased. This increase in the available milling space is particularly apparent in the mills which have a diameter, at their interior, of more than three meters. Thus by reason on the increased hollow interior space the specific weight of the mill is reduced. As was pointed out above, the radii of curvature of the rounded corners provided by way of the plates 2 are greater than the radii of curvature of the rounded corners provided by way of the plates 1. By way of selecting the magnitudes of these radii of curvature it is possible to achieve a considerable influence on the milling process inasmuch as a reduction or increase of the radii of the rounded corners or rounded star points with respect to the lengths of the sides of the squares will result in an increase or decrease in the impact action within the mill. By duplicating the square cross section in the interior of the mill in the manner described above it is possible with mills of relatively large diameter to integrate into the milling operation to a very great extent the large dead space which otherwise would exist in a mill having an interior of a simple square cross section with rounded corners, so that in this way the actual space within which milling operations are carried out is increased.

Thus, instead of having in the interior of the mill a square-shaped cross section having four rounded corners, the cross-sectional configuration of the interior space of the mill of the invention, in any plane normal to the axis of the mill, has eight rounded corners all of which may be of the same radius of curvature or which may have different radii of curvature as described above in such a way that the radius of curvature of every other rounded corner is the same. As a result of this configuration the angle at which the milling bodies are thrown inwardly away from the inner surface of the mill is influenced in such a way that this angle of departure of the milling bodies inwardly away from the surface of the mill continuously changes its magnitude with the locations where the milling bodies are thrown inwardly away from the inner surface of the mill being a function of the angle at which these milling bodies are thrown inwardly toward the interior of the mill, which is to say an angle which continuously changes and which is continuously varying, during operation of the mill. As a result of this feature, the parabolic paths of travel of the thrown milling bodies will provide for the latter not a single impact point but rather a number of scattered impact points. Thus as a result of this feature the probability of accurately achieving impacts between the milling bodies, such as balls, and the material to be milled, is increased to the same extent as the angle of scatter of the milling bodies.

By way of the double-square configuration of the cross section of the space surrounded by each ring, it is possible to form along the interior of the mill as a result of the angular offset of one ring with respect to the next the equivalent of an internal screw having eight threads with the feeding or transport of the milling bodies and the material to be milled being influenced according to the selection of the angle of offset from one ring to the next. The result is a classification of the milling bodies inasmuch as the larger milling bodies will become located primarily at the entrance region of the mill into which the material to be milled is initially fed while the smaller bodies will for the most part collect at the outlet end region of the mill.

By way of a specific example, in a cement mill there is a preliminary first chamber for providing a preliminary pulverizing or reduction in size of the particles of the milled material, this reduction in this first chamber being from a granular size of 80 mm. down to a granular size of 1 mm. Tests have shown that during this preliminary reduction in the size of the particles the charge of milling balls which are mixed with the material to be milled will provide an improved throughput capacity of up to 10% as a result of the classification of the milling balls in the above manner according to which the larger milling balls are located primarily at the entrance region and the smaller milling balls primarily at the exit region of the mill.

Furthermore, it is to be noted that the double-square cross-sectional configuration of the space surrounded by the several rings does not produce a uniform multiple thread along the interior of the mill but instead permits a non-uniform haphazard offsetting of one ring with respect to the next without increasing the dynamic loading of the mill. In the event that the lining in the interior of the shell is made up of rings which are not angularly offset, as shown in Austrian Pat. No. 239,634, then during operation of the mill there will be provided at each revolution four heavy impacts which result in an excessive dynamic stressing of the mill. By way of the cross-sectional configuration of the interior space surrounded by each ring of the liner means, in accordance with the present invention, a single offsetting of one ring with respect to the next increases the number of impacts for each revolution up to sixteen, so that the impacts are widely distributed during each revolution to reduce very greatly the extent to which the mill is stressed.

In the event that it is desired to achieve in a mill a particularly pronounced classification of the milling bodies, so that, for example, the milling bodies progressively become of smaller size from the entrance toward the exit of the mill, then it is possible to provide rings as shown in FIG. 4 and described above according to which the inner surfaces of the rings are inclined with respect to the axis of the mill so as to have a non-parallel relationship with respect thereto, although it is not necessary to provide such an inclination for the inner surfaces of all of the rings since a similar effect can be achieved by providing a suitable inclination for only some of the rings. With such a construction it is possible to maintain the classification of the milling bodies along the axis of the mill even under conditions of extreme loading of the mill.

In the event that the radii of curvature of the rounded corners of one of the superimposed squares determining the interior cross-sectional configuration of the mill is on the order of one third of the length of a side of the square, then it is possible to achieve the largest amount of frictional rubbing between the milling bodies and the material to be milled so as to achieve an attrition type of milling action. On the other hand, if the radii of the rounded corners of one of the squares determining the interior cross-sectional configuration of the mill is on the order of one quarter of the length of a side of the square, then the result is an intense dropping or falling movement of the milling bodies achieving in this way a milling action resulting from impact, without on the other hand creating an excessively large loss of milling space. As is indicated in FIGS. 1 and 2, it is possible to combine these two different types of milling actions by way of the two different squares which have rounded corners of different radii so that during rotation of the mill the milling bodies are subjected to a rolling as well as a dropping or falling movement, with the rolling movement alternating with the falling movement, so that by way of these features it is possible to an extremely large extent to influence the properties of the granular material achieved as a result of the milling, these properties including, for example, maintaining the size of the milled particles within a predetermined range.

The double-square cross-sectional configuration of the interior space defined by each ring of the liner means of the invention is not to be compared with the lifting capacity of a conventional mill liner inasmuch as by way of the radii of curvature of the rounded corners of the two superimposed squares with the structure of the invention there is provided within the mill an additional type of movement of the milling bodies. Liners designed only to raise the milling bodies only have the objective of preventing sliding of the bed of milling bodies along the inner surface of the mill while bringing about instead a correspondingly high lifting of the milling bodies.

Moreover, since the critical speed of revolution of the mill depends directly upon the diameter of the mill, it will be seen that the mill of the invention has a variable internal diameter so that as a result of the configuration of the interior mill space according to the invention the critical speed of rotation of the mill is correspondingly varied.

What is claimed is:

1. In a tumbling mill, such as a ball or tube mill, outer cylindrical shell means having a central axis and inner liner means situated within and carried by said shell means, said liner means including a series of rings distributed along and each surrounding said axis with each ring being made up of a series of plates circumferentially distributed about said axis, said liner means defining therein a hollow interior space surrounded by said liner means and having in a plane normal to said axis a star-shaped cross-sectional configuration defined by a plurality of concavely rounded outer corners and a plurality of inner corners, said inner corners each defining a sharp point extending inwardly toward said central axis, said outer and inner corners being distributed in an alternating manner circumferentially about said axis, and wherein each ring surrounds a space having said cross-sectional configuration and is angularly offset with respect to an adjoining ring so that the angular orientation of the rounded star corners provided by one ring is different from the angular orientation of the star corners provided by an adjoining ring such that said star-shaped cross-sectional configuration is formed by a pair of squares defining said rounded corners and which are angularly offset one with respect to the other with the rounded corners of one of said squares alternating with the rounded corners of the other of said squares to provide the configuration of an eight-pointed star having said rounded outer corners and said sharply pointed inner corners, the rounded corners of one of said squares all having equal radii of curvature and the rounded corners of the other of said squares also having equal radii of curvature, with the latter radii of curvature being different from the radii of curvature of said one square.

2. The combination of claim 1 and wherein the angular offset of said rings one with respect to the next along said axis is non-uniform.

3. The combination of claim 1 wherein at least some of said rings have inner surfaces which are inclined with respect to said axis so as to have a non-parallel relationship with respect thereto.

4. The combination of claim 1 further including bedding means situated between said shell means and at least some of said plates of some of said rings for supporting the latter plates in the interior of said shell means.

5. The combination of claim 1 and wherein said hollow interior space has a diameter which is greater than three meters.

* * * * *